US005315767A

United States Patent [19]

Bradbury

[11] Patent Number: 5,315,767

[45] Date of Patent: May 31, 1994

[54] SHOE SOLE SAVER

[76] Inventor: Frank M. Bradbury, 485 Penguin Dr., Satellite Beach, Fla. 32937

[21] Appl. No.: 624,886

[22] Filed: Dec. 7, 1990

Related U.S. Application Data

[63] Continuation-in-part of Ser. No. 404,352, Sep. 7, 1989, abandoned.

[51] Int. Cl.[5] ..... A43B 3/16; A43B 3/18

[52] U.S. Cl. ..... 36/7.1 R; 36/135; 36/7.3

[58] Field of Search ..... 36/7.1 R, 7.3, 7.5, 36/7.6, 135, 7.4, 9 R, 31, 103

[56] References Cited

U.S. PATENT DOCUMENTS

| | | | |
|---|---|---|---|
| 1,465,504 | 8/1923 | Wiegand . | |
| 1,811,781 | 6/1931 | Degge | 36/135 |
| 2,068,238 | 1/1937 | Malm . | |
| 2,440,563 | 4/1948 | Woyach . | |
| 3,263,348 | 8/1966 | Cohen et al. | 36/135 |
| 3,313,047 | 4/1967 | Svien . | |
| 3,724,107 | 4/1973 | Makinen . | |
| 4,258,483 | 3/1981 | Hogue | 36/7.5 |
| 4,398,357 | 8/1983 | Batra | 36/31 |
| 4,434,565 | 3/1984 | Haley . | |
| 4,441,264 | 4/1984 | Hantz-Guibas et al. | 36/72 B |
| 4,516,336 | 5/1985 | Nissenbaum | 36/7.3 |
| 4,554,749 | 11/1985 | Ostrander | 36/31 |
| 4,564,966 | 1/1986 | Chen | 36/31 |
| 4,693,019 | 9/1987 | Kim . | |
| 4,779,360 | 10/1988 | Bible . | |
| 4,872,273 | 10/1989 | Smeed . | |

FOREIGN PATENT DOCUMENTS

| | | | |
|---|---|---|---|
| 3205444 | 2/1982 | Fed. Rep. of Germany . | |
| 1195053 | 11/1959 | France | 36/7.3 |
| 12812 | 4/1905 | United Kingdom | 36/7.5 |
| 157698 | 9/1920 | United Kingdom . | |

*Primary Examiner*—Steven N. Meyers

*Attorney, Agent, or Firm*—Evenson, Wands, Edwards, Lenahan & McKeown

[57] ABSTRACT

A removable, durable, substitute sole for removable attachment to an athletic shoe (10) is provided. The substitute sole may be provided on or as part of an all-rubber elastic and stretchable overshoe (20) formed so that the upper part of the overshoe maintains intimate and snug fit with the inner shoe, but still permits air flow, heat dissipation and perspiration evaporation. A durable sole (30) may be attached by an elastomeric bonding agent or the toe and heel portions (32, 34) made more wear-resistant as part of the manufacturing process of the overshoe.

4 Claims, 3 Drawing Sheets

SHOE SOLE SAVER

This application is a continuation-in-part application of copending U.S. patent application Ser. No. 07/404,352 filed on Sep. 7, 1989 now abandoned.

This invention relates to a removable, durable, substitute sole for attachment to athletic shoes for play on hard-court surfaces.

BACKGROUND OF THE INVENTION

Frequent use of current high-tech and costly tennis shoes on court surfaces made of concrete often results in a shoe sole wear-out in a matter of weeks and requires discarding of a shoe costing from $50.00 to $80.00. Presently, the two popular ways to combat this problem are generally considered unsatisfactory. One is to use a "shoe goo" substance to temporarily cover worn areas on the sole and the other is to have the shoe re-soled by a specialty repair shop. Re-soling may cost $20.00, take several weeks and result in shoe reshaping and foot discomfort.

It is known to provide shoes, and particularly athletic shoes, with "overshoes". However, these overshoes are not designed or used for protecting the sole from excessive wear, such as that caused by playing tennis on hardcourts. Instead, the known overshoes are designed to either protect the shoe from the elements, to protect various surfaces from the footwear, or to increase traction.

Examples of overshoes that protect a shoe from the elements are shown in U.S. Pat. Nos. 1,465,504; 2,068,238; 2,440,563; and 3,724,107. They typically consist of a rubber material that is stretched over the shoe and protect the shoe from rain, snow, etc. They are not designed for protecting the sole of an athletic shoe from wear such as that experienced when used playing tennis on a hardcourt.

Overshoes which are designed to protect various surfaces from the footwear are described in U.S. Pat. Nos. 3,313,047; 4,693,019; 4,872,273; and German Patent Document DE 32 05 444. The U.S. Patents describe shoe covers that are designed to fit over, for example, shoes having golf spikes so that the shoes may be worn indoors without harming floor surfaces.

The German Patent Document describes an overshoe that is designed for covering a tennis shoe when the tennis shoe is worn indoors. Such an overshoe is needed to protect an indoor floor after tennis from dirt or clay that adheres to the shoe when playing tennis on a clay court, such as the majority of the tennis courts found in Germany. Thus, the overshoe described in this German Patent Document does not protect the shoe sole from wear on the tennis court, but rather protects an indoor floor from the shoe and the dirt from the tennis court. To accommodate the particles of dirt and clay, this overshoe would necessarily be oversized, making it unsuitable for use during play due to weight and slippage between the overshoe and the shoe.

Overshoes which are designed to increase traction are described in, for example, U.S. Pat. Nos. 4,434,565 and 4,779,360. These are not designed for protecting the soles of the shoes from wear such as that experienced in playing tennis on a hardcourt.

SUMMARY OF THE INVENTION

The object of the invention is to provide a substitute or replacement sole for use with athletic shoes to extend the life of the athletic shoe by replacing merely the sole when worn through rather than replacing the shoe itself. The invention thus provides a novel means for attaching a substitute or replacement sole to athletic footwear of a known type. The substitute sole may be used with athletic shoes when new or after use.

Another object of the present invention is to provide a low cost shoe sole saver which results in improved cushioning and comfort to the foot, ankle and knee joints.

A further object of the invention is to provide a novel light-weight, all rubber elastic auxiliary sole having a full sole except for possibly the arch portion with increased durability at the toe and heel portions. A sole tread is provided for footing on concrete surfaces which in some instances may become slick due to moisture or sand. An auxiliary toe and heel portion made of rubber or similar material may be secured by a bonding agent which provides permanent flexible bonding. Alternatively, the auxiliary sole according to the invention may, in the manufacturing process, incorporate material more wear-resistant than conventional overshoe soles to avoid added gluing procedures.

In actual play on a concrete tennis court, the substitute sole attachment of the present invention, which serves as a sole saver for extending tennis shoe life, performed surprisingly well. The composite shoe maintained a snug fit and did not impede mobility. The few ounces of added weight were not a factor and the substitute sole saver soon felt like it was part of the tennis shoe. The composite shoe also reduced the jarring which occurs on hard court surfaces and provides a real bonus to those with ankle and knee problems.

These and other objects of the invention will become more fully apparent from the claims and from the description as it precedes in connection with the drawings.

DETAILED DESCRIPTION OF THE DRAWINGS

Figure 1:
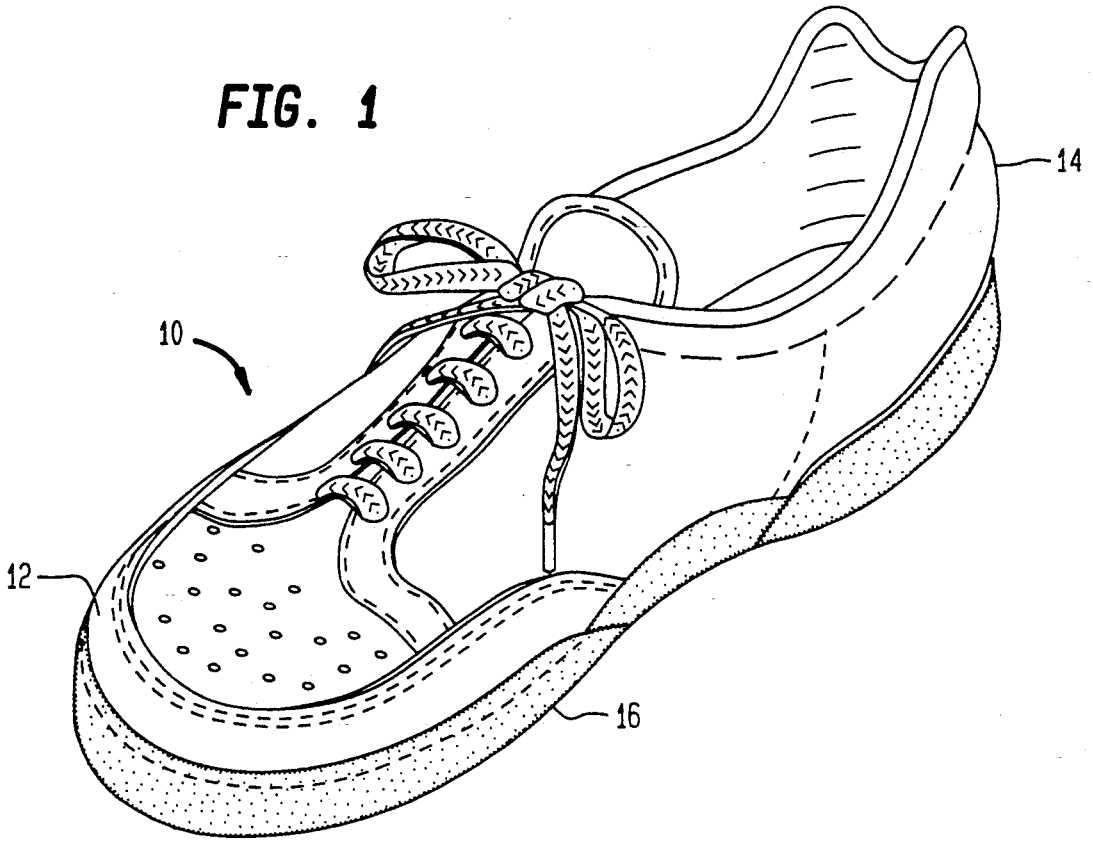
FIG. 1 is a pictorial drawing of a conventional tennis shoe.

The conventional inner shoe 10 of FIG. 1 may be of the type used for athletic footwear on hard courts that are made with a concrete playing surface. Vigorous play on such courts can result in sole wear-through in a short time.

Figure 2:
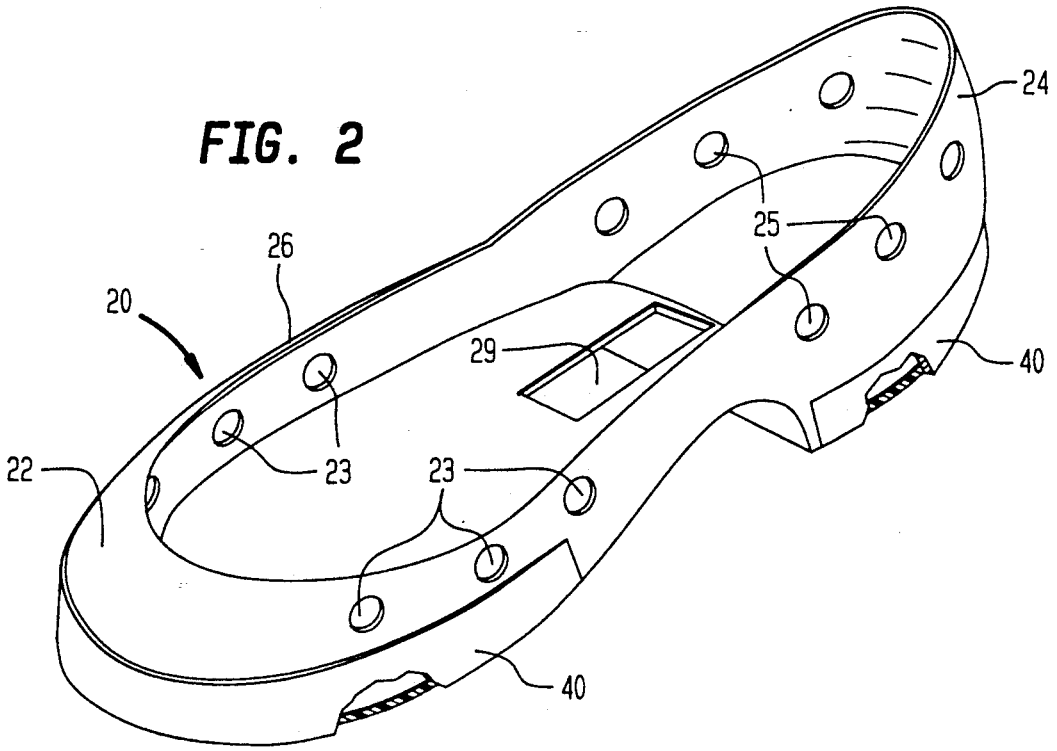
FIG. 2 is a pictorial drawing of a stretch auxiliary sole made in accordance with the present invention.
Figure 3:
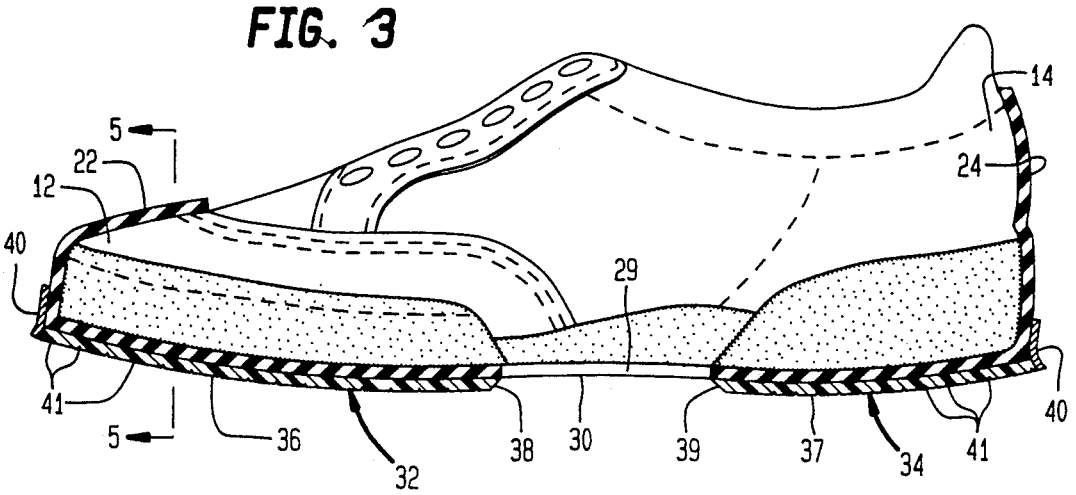
FIG. 3 is an elevation of the shoe of FIG. 1 inserted in the auxiliary sole of FIG. 2 with the auxiliary sole being shown in section.

The auxiliary sole 20 of FIG. 2 may be a modified lightweight, low-cut sole of a rubber or other elastic material of the general type such as disclosed in the Jackson U.S. Pat. No. 2,254,685 or of a type that is commercially available. The upper toe surface 22 is shown in FIG. 3 to fit over the top portion 12 of the tennis shoe 10 and the rear heel surface 24 extends upwardly along the heel portion 14 of the tennis shoe 10.

The auxiliary sole 20 is made of a unitary piece of a stretchable rubber-like material. Several small circular openings 23 may be provided along the upper side portion of the toe area 22 with several openings 25 provided along the upper side portion of the heel area 24 to allow air flow between the auxiliary sole 20 and the tennis shoe 10, heat dissipation, and perspiration evaporation. There also may be a large rectangular opening 29 in the arch section of the sole of the auxiliary sole 20 for similar reasons.

The stretch auxiliary sole 20 of FIG. 2 can thus be placed over the tennis shoe 10 to be worn and removed from the tennis shoe 10 by stretching the side portions 26 of the auxiliary sole in a familiar manner. The auxiliary sole 20 fits on the tennis shoe 10 in a manner that is sufficiently snug to prevent slippage or movement during tennis play.

The sole 16 of the tennis shoe 10, other than the arch portion, is totally covered by the bottom 30 of the auxiliary sole thereby to provide a substitute sole for attachment to the inner shoe.

Figure 4:
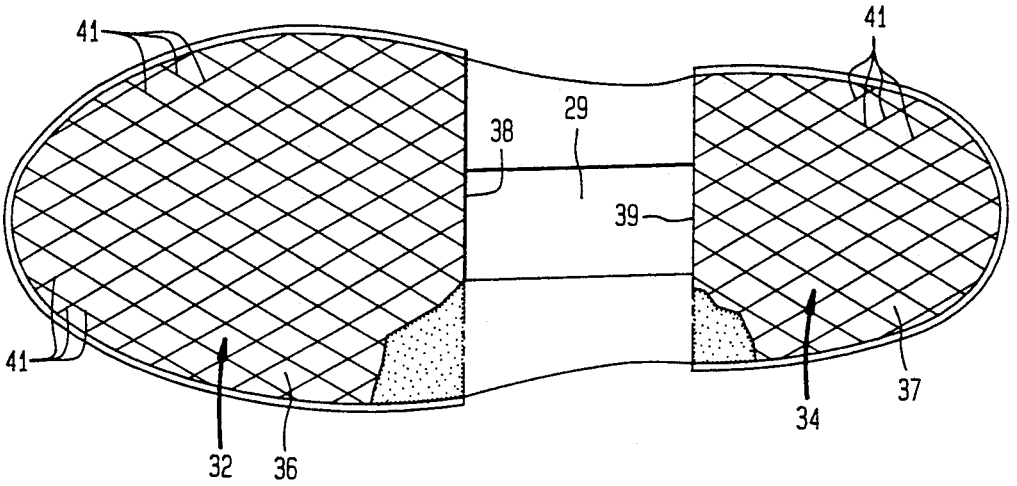
FIG. 4 is a bottom view of the auxiliary sole of FIG. 2.
Figure 5:
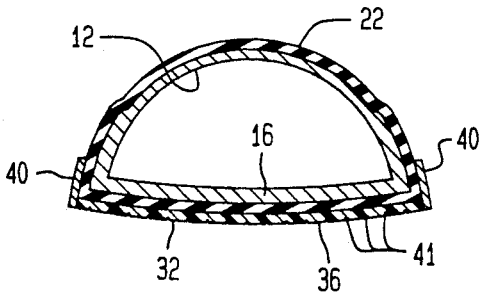
FIG. 5 is an end view in section taken along line 5—5 of FIG. 3.

The substitute sole toe portion 32 and the heel portion 34 that are exposed to the abrasive or concrete playing surface may incorporate a tread design for improved footing on such surfaces which may become slick due to moisture or sand. A waffle-like tread design as illustrated in FIG. 4 provided enhanced footing and reduces the tendency to skid on concrete surfaces when slick under damp or sandy conditions. The waffle-like appearance may be formed by grooves 41 that are oriented to cross as illustrated.

The substitute sole toe surface portion 32 and heel surface portion 34 are made wear-resistant as by adding a layer 36 of wear resistant material such as Indy 500 rubber, dual or triple density rubber, polyurethane, or other synthetic material commonly used as a shoe sole that is attached to the bottom 30 of the auxiliary sole 20 by any suitable flexible bonding agent that will adhere to the surface interface between the bottom 30 and the respective layers 36, 37. These relatively more expensive materials can be provided only at the toe and heel sections of the auxiliary sole since these are the areas that are subject to the most wear. The remaining portions of the auxiliary sole can be made of different material that is not as wear-resistant and is relatively less expensive. To avoid the need for the use of adhesive, the auxiliary sole 20 may be originally made of such wear-resistant materials to provide increased resistance to wear through in the toe and heel portions.

The toe layer 36 is shaped to conform generally to the shape of the auxiliary sole toe area shown generally at 32 in FIG. 4 and terminates at a position illustrated by line 38 which is in front of the arch portion of the foot. The heel layer 37 is shaped to conform generally to the shape of the auxiliary sole heel portion shown generally at 34 and terminates at a position illustrated by line 39 which is just rearwardly of the arch portion of the foot. The stretch characteristic of the auxiliary sole is thus retained in the side walls and at the arch portion even though the toe and heel layers 36, 37 may be made to have more rigid properties than the remainder of the stretch auxiliary sole.

To colorize the auxiliary sole and make it appear to be part of the tennis shoe, a band 40 of rubber, usually white, may be applied to the periphery of the usually dark colored auxiliary sole material around the upper part of the sole area as is common with tennis shoe construction.

In order not to tire the wearer, the auxiliary sole 20 should be lightweight, for example 6 ounces each. Because of the stretch characteristic of the auxiliary sole 20, one size can be used with several inner shoe sizes.

Also, it is contemplated that the auxiliary sole 20 will be produced using conventional compression molding process which entails the lowest tooling expense. The mole will be a 2-cavity type—produce one right and one left.

Figure 6:
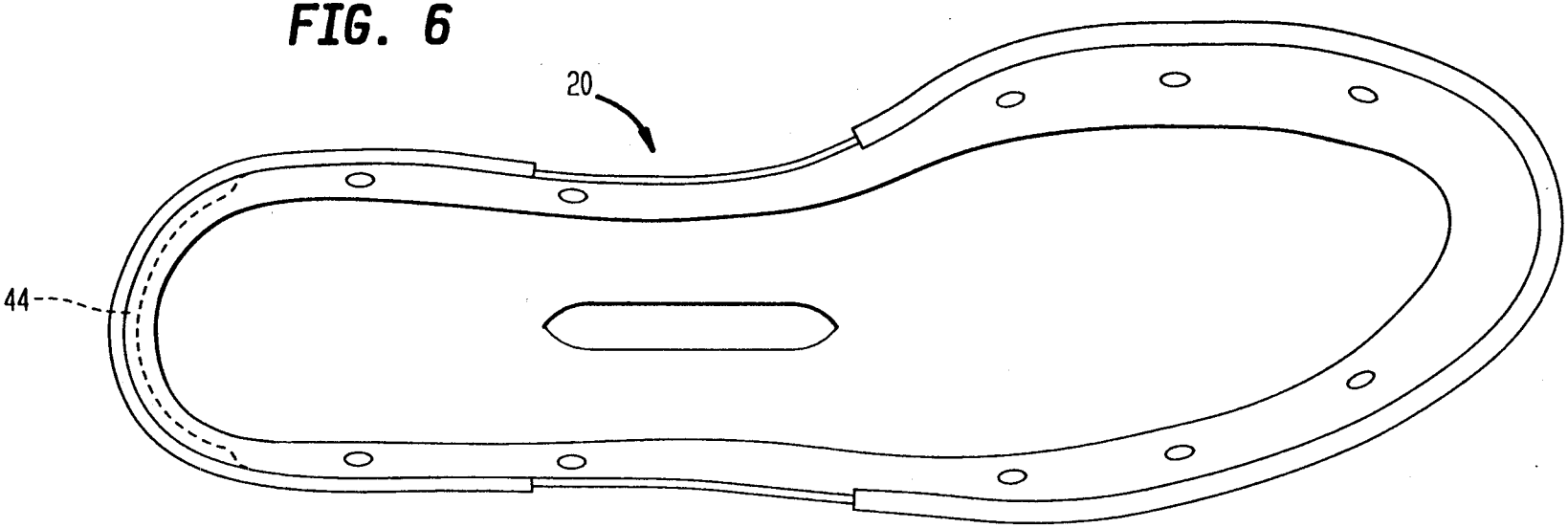
FIG. 6 is a top view of the stretch auxiliary sole constructed in accordance with FIG. 2.
Figure 7:
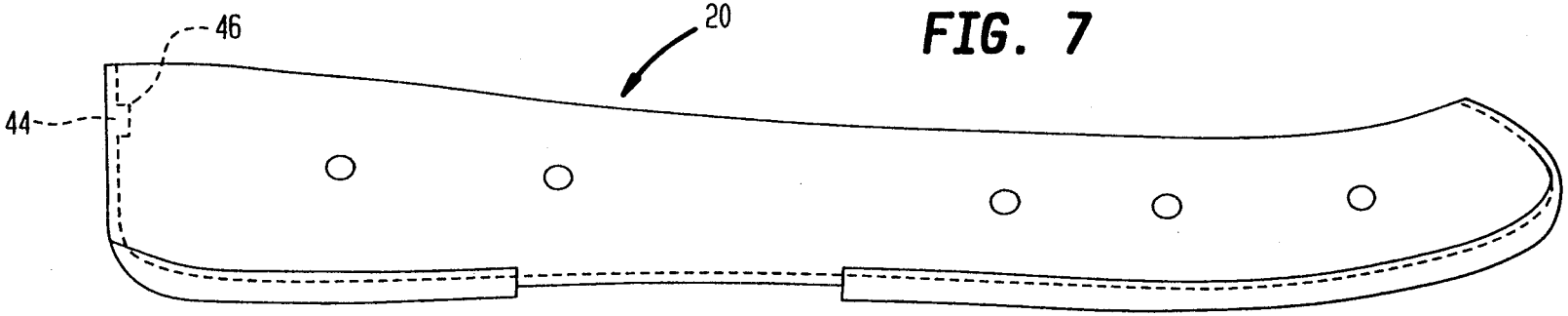
FIG. 7 is a side view of the auxiliary sole of FIG. 2.

As illustrated in FIGS. 6 and 7, the auxiliary sole 20 includes a molded rim 44 that is located in the heel portion of the auxiliary sole 20. This rim 44 presses on the heel of the shoe and acts to keep the heel of the shoe in place, an important performance consideration for play on a hardcourt tennis surface. The rim 44 can be, for example, ¼ inch wide and extend inward approximately ⅛ inch. The shoe itself has a groove 46 (formed where the shoe sole is attached to the shoe body, FIG. 1)) which receives this rim 44 in order to provide an even more secure attachment of the auxiliary sole 20 to the shoe.

The embodiments of the invention described above are illustrative and not intended to be restrictive. All equivalents and modifications which fall within the scope of the appended claims are intended to be covered thereby.

What is claimed is:

1. A composite shoe having a substitute sole attachment for use in a sporting activity on a hard playing surface including:

an inner shoe having a sole and upper portion adapted for wear while engaging in sporting activities; and means for attaching a substitute sole for sports play, said attaching means comprising:

a stretch outer shoe which is removably attached to said inner sole by stretching the outer shoe over the entire sole and an adjacent upper portion of a periphery of the inner shoe, said outer shoe extending upwardly from the shoe sole and maintaining a snug fit with said shoe due to elastic properties of said outer shoe; and said outer shoe having an auxiliary sole for athletic play on a hard playing surface, said sole being constructed, at its toe and heel portions, of a material different from that of other portions of the sole of said outer shoe, said material having a greater resistance to wear-through at said toe and heel portions than at said other portions of the auxiliary sole of said outer shoe; and wherein the toe and heel portions of the outer shoe include two separate members made of said material and individually attached by a flexible bonding agent to an outer surface area of the respective toe and heel portions of the outer shoe and separated by an arch portion that has greater stretchability than the toe portion or the heel portion with said separate members.

2. The composite shoe as defined in claim 1, wherein the arch portion of the auxiliary sole contains an aperture to permit air flow to the sole of the inner shoe.

3. The composite shoe as defined in claim 1, wherein the inner shoe is a tennis shoe;

the stretch outer shoe is shaped and sized with a plurality of strategically shaped openings to snugly engage the peripheral region of the tennis shoe sole and the adjacent upper portion of the tennis shoe to prevent relative movement or slippage between the tennis shoe and the stretch overshoe while also allowing air flow, heat dissipation and perspiration evaporation; and the outer shoe auxiliary sole surface which is adapted to engage a court surface has a tread surface to enhance footing.

4. A method of extending the life of an athletic shoe which is worn during a sports activity on a hard surface that subjects the sole of the shoe to wear during said sports activity, comprising the steps of:

(a) providing a stretch auxiliary sole made of a body of elastic material formed so that said auxiliary sole is maintained in intimate and snug fit with said athletic shoe to prevent movement or slippage during said sports activity, said stretch auxiliary sole including a sole having toe and heel portions separated by an arch portion and an adjacent wall portion extending around the periphery of the sole so as to permit the auxiliary sole to snugly engage and be removably attached to said athletic shoe, said toe and heel portions of said auxiliary sole containing a material which contacts said hard surface during said sports activity and is compositionally different from that of said arch portion of said auxiliary sole, said compositionally different material having a greater resistance to wear than said arch portion of said auxiliary sole; and (b) wearing said auxiliary sole in a snug fit engagement with said athletic shoe during said sports activity on said hard surface, so that the toe and heel portions, which contain greater resistance to wear material, contact said hard surface during said sports activity and thereby maintain the effective use of said athletic shoe during said sports activity.

* * * * *